US005551848A

United States Patent [19]

Chuang et al.

[11] Patent Number: 5,551,848

[45] Date of Patent: Sep. 3, 1996

[54] ATTACHMENT MECHANISM FOR PORTABLE HAND PUMP

[76] Inventors: Louis Chuang, No. 7th Floor-8, No. 20, Ta Lon Road, Taichung; Scott Wu, No. 2, Lane 296, Ming Sheng Road, Wu Feng, Hsiang, Taichung, both of Taiwan

[21] Appl. No.: 514,802

[22] Filed: Aug. 14, 1995

[51] Int. Cl.[6] ..... F04B 53/00

[52] U.S. Cl. ..... 417/437; 92/58.1; 285/163

[58] Field of Search ..... 417/437, 555.1; 92/58.1; 285/163, 168, 280

[56] References Cited

U.S. PATENT DOCUMENTS

| | | | |
|---|---|---|---|
| 695,199 | 3/1902 | Eddy | 92/58.1 |
| 1,737,534 | 8/1927 | Davis | 417/555.1 |

FOREIGN PATENT DOCUMENTS

| | | | |
|---|---|---|---|
| 515779 | 8/1955 | Canada | 417/437 |
| 1127235 | 12/1956 | France | 92/58.1 |

*Primary Examiner*—Timothy S. Thorpe
*Assistant Examiner*—William Wicker
*Attorney, Agent, or Firm*—Charles E. Baxley, Esq.

[57] ABSTRACT

A portable hand pump includes a housing having a hole for rotatably engaging with an extension of a tube. A hose and an attachment member are secured to the tube such that the attachment member may rotate about the extension and may be easily engaged with the air valves. A lock member is secured to the hose and a connector is fixed on top of the lock member. A barrel is rotatably engaged on the connector. The attachment member is fixed to the barrel such that the attachment member may rotate relative to the connector and may be easily engaged with the air valves.

1 Claim, 6 Drawing Sheets

ATTACHMENT MECHANISM FOR PORTABLE HAND PUMP

BACKGROUND OF THE INVENTION

1. Field of the Invention

The present invention relates to a hand pump, and more particularly to an attachment mechanism for a portable hand pump.

2. Description of the Prior Art

A typical portable hand pump is shown in FIG. 6 and comprises a housing 10 including a foot pedal 11 provided on the bottom and including an outlet pipe 12 for coupling to a hose 13 which is coupled to an attachment mechanism for engaging with air valves. The outlet pipe 12 is solidly secured to the housing 10 and may not be rotated relative to the housing 10 such that the hose 13 may easily be deformed while using and such that the air may be blocked and may not be effectively pumped through the attachment mechanism.

The present invention has arisen to mitigate and/or obviate the afore-described disadvantages of the conventional hand pumps.

SUMMARY OF THE INVENTION

The primary objective of the present invention is to provide an attachment mechanism for a portable hand pump in which the attachment mechanism may be rotated relative to the housing of the hand pump in order to prevent the hose from being deformed and in order to facilitate the air pumping operations.

In accordance with one aspect of the invention, there is provided a portable hand pump comprising a housing including a bottom portion having a hole laterally formed therein, a tube including an extension rotatably engaged in the hole of the housing, the extension including a bore formed therein and including an opening formed therein for communicating the bore with the hole of the housing, means securing the extension to the housing so as to allow the extension to rotate relative to the housing, a hose including a lower portion secured to the tube and including an upper portion, and an attachment member secured to the upper portion of the hose. The extension is rotatable relative to the housing so as to allow the hose and the attachment member to rotate about the extension.

A lock member is secured to the upper portion of the hose and includes an inner thread formed therein, a connector includes an annular slot formed therein for engaging with a sealing ring and includes a lower portion threadedly engaging with the inner thread of the lock member, and a barrel is rotatably engaged on the connector and includes an upper portion having an inner thread formed therein and includes a lower portion having an annular rib extended radially inward therefrom for engaging with the connector so as to prevent the barrel from disengaging from the connector. The attachment member includes an outer thread for engaging with the inner thread of the barrel so as to be secured to the barrel. The barrel is rotatable relative to the connector so as to allow the attachment member to rotate relative to the connector.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
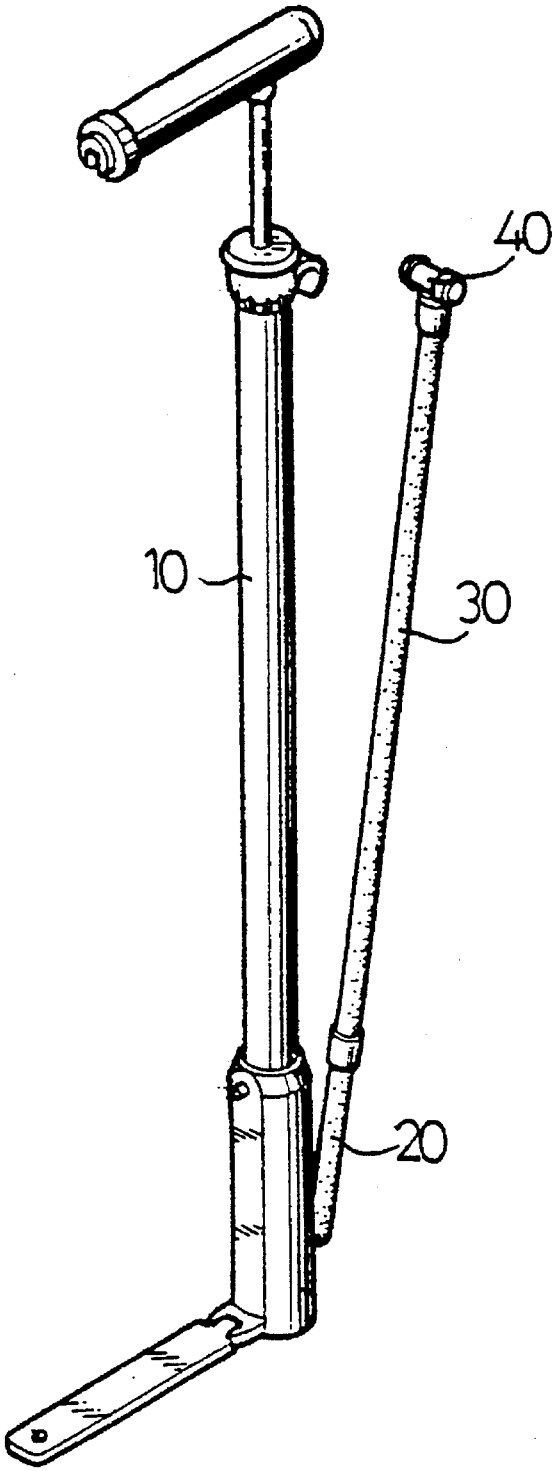
FIG. 1 is a perspective view of a portable hand pump in accordance with the present invention.

Referring to the drawings, and initially to FIGS. 1 to 3 and FIG. 5, a portable hand pump in accordance with the present invention comprises a housing 10 including a bottom portion. A tube 20 includes an extension 21 laterally extended from the bottom portion thereof for rotatably engaging in a hole 16 which is laterally formed in the bottom portion of the housing 10 and which is communicating with the hollow interior of the housing 10 via a passageway 17, best shown in FIG. 5. The extension 21 includes an outer diameter slightly smaller than the inner diameter of the hole 16 such that an air pathway is formed between the extension 21 and the inner peripheral portion of the hole 16. The extension 21 includes two sealing rings 23 engaged on two annular grooves 222 thereof and includes a bore 22 for communicating with the hollow interior 201 of the tube 20 and includes an opening 221 formed between the sealing rings 23 and communicating with the bore 22 such that the air from the housing 10 may flow into the bore 22 of the extension 21 via the passageway 17 and the opening 221. A bolt 25 is engaged with the end portion of the extension 21 and a spring 26 is biased between the bolt 25 and the housing 10 for resiliently retain the extension 21 in place. The tube 20 may thus be rotated relative to the housing 10 about the extension 21 thereof.

Figure 2:
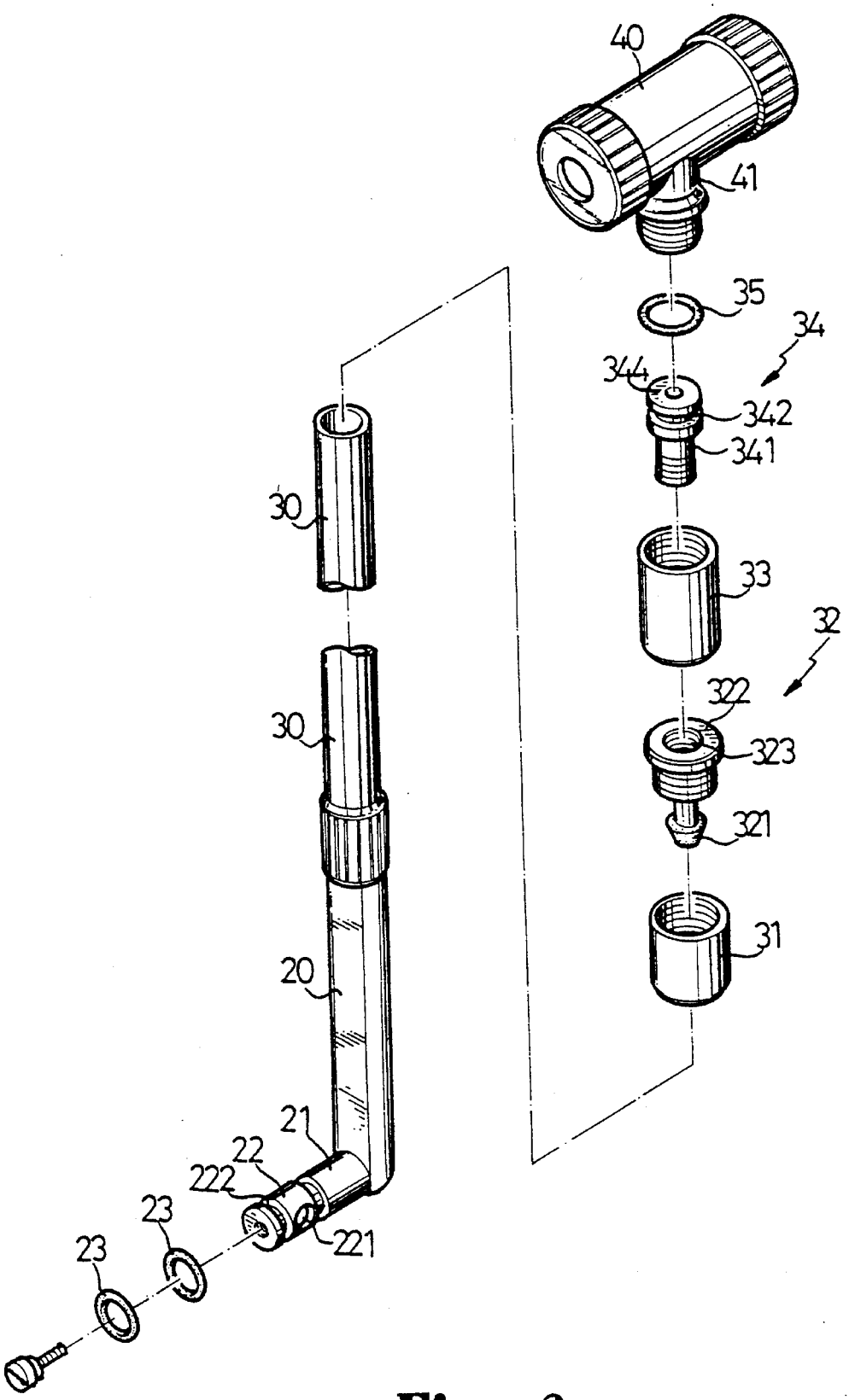
FIG. 2 is an exploded view of the attachment mechanism for the portable hand pump.
Figure 3:
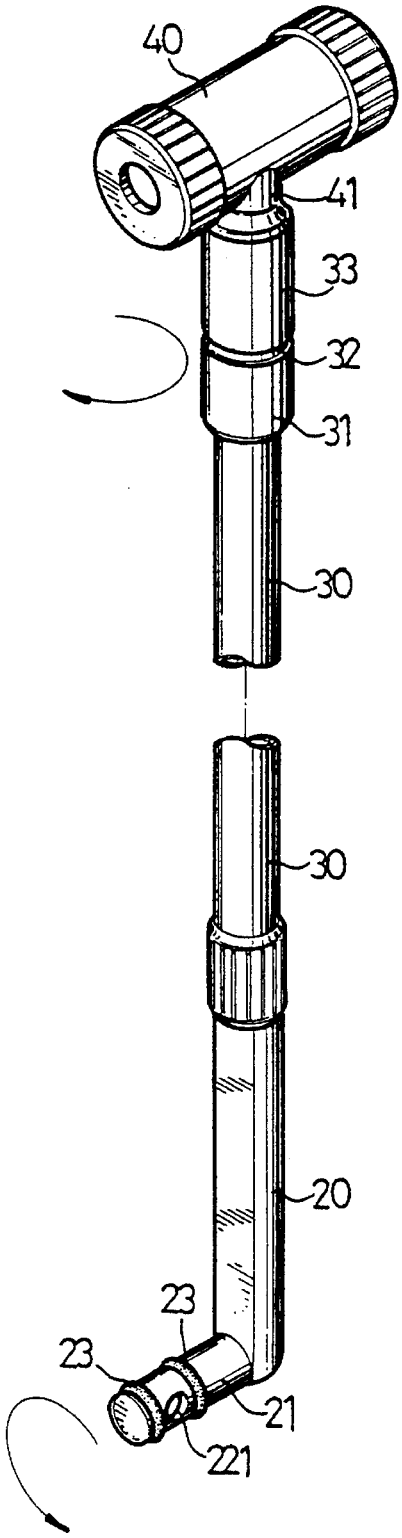
FIG. 3 is a perspective view of the attachment mechanism for the portable hand pump.
Figure 4:
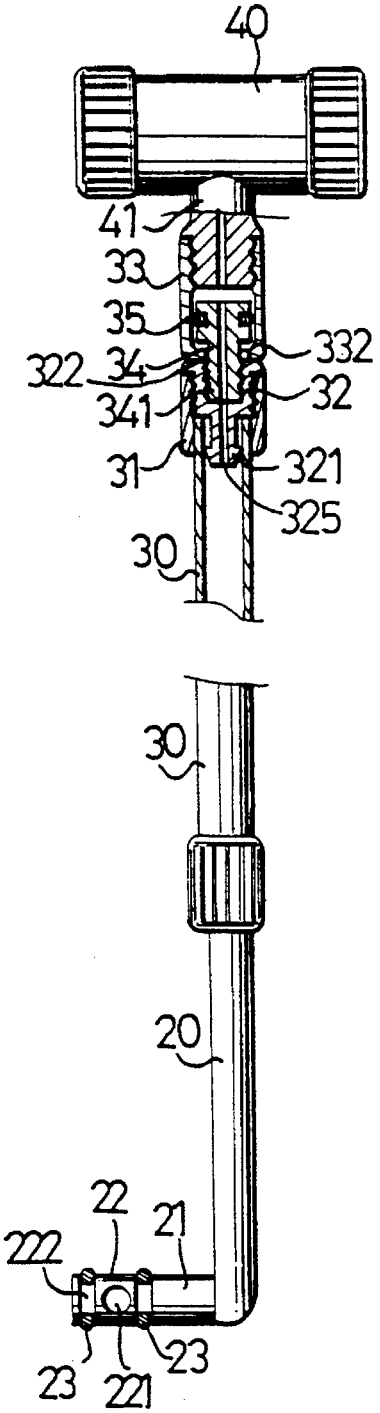
FIG. 4 is a plane view of the attachment mechanism, in which a portion of the attachment mechanism is cutoff for illustrating the interior of the attachment mechanism.
Figure 5:
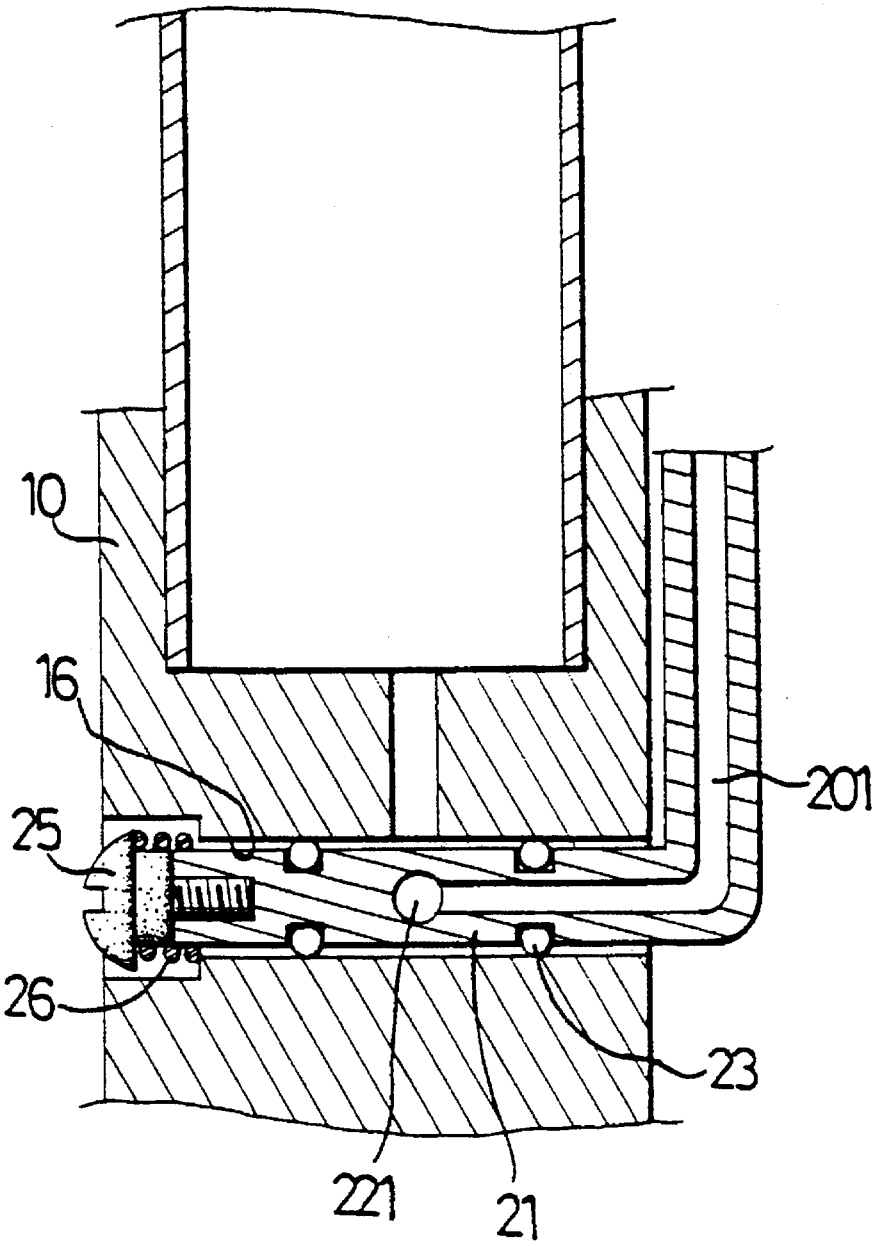
FIG. 5 is a partial cross sectional view illustrating the bottom portion of the hand pump.
Figure 6:
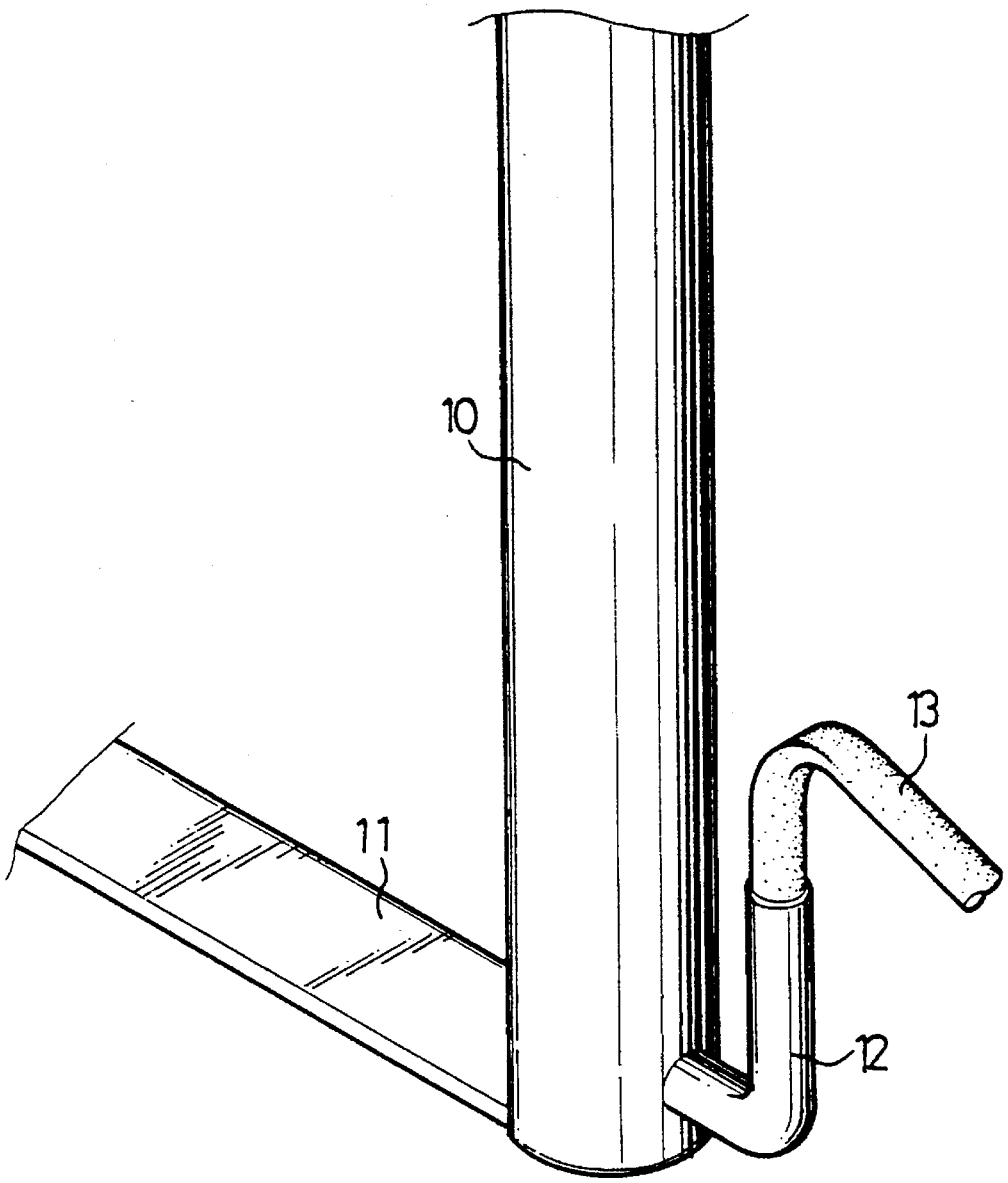
Fig 6 PRIOR ART
FIG. 6 is a partial perspective view of a typical hand pump.

Referring next to FIG. 4 and again to FIGS. 2 and 3, a flexible hose 30 is secured on top of the tube 20 and includes an upper end engaged in a sleeve 31 which includes an inner thread formed therein. A lock element 32 includes an outer thread for engaging with the inner thread of the sleeve 31 so as to be secured to the sleeve 31 and includes an annular flange 322 for engaging with the top of the sleeve 31 and includes a secure element 321 for engaging with the hose 30 and for securing the hose 30 in the sleeve 31. The lock element 32 includes an inner thread 323 formed therein and includes an orifice 325 formed therein for communicating with the hollow interior of the hose 30.

A connector 34 includes a lower portion 341 having an outer thread for engaging with the inner thread 323 of the lock element 32 and includes an annular slot 342 formed therein for engaging with a sealing ring 35. A barrel 33 is engaged on top of the lock element 32 and includes an annular rib 332 extended radially inward from the bottom portion for engaging with the connector 34 so as to prevent the barrel 33 from disengaging from the connector 34. The barrel 33 may move up and down relative to the connector 34. The barrel 33 includes an inner thread 331 formed in the upper portion for engaging with an outer thread of a branch 41 of an attachment member 40 such that the attachment member 40 and the barrel 33 may rotate relative to the connector 34 and such that the attachment member 40 may be easily engaged with the air valves. The connector 34 includes an aperture 344 formed therein and communicating with the orifice 325 of the lock element 32 such that the pressurized air from the housing 10 may flow through the attachment member 40 via the extension 21 and the tube 20 and the hose 30 and the lock element 32 and the connector 34.

Accordingly, the portable hand pump in accordance with the present invention includes a tube that may be rotated relative to the housing and includes an attachment member that may be rotated relative to the hose such that the hose will not be deformed and such that the attachment member may be easily engaged with the air valves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A portable hand pump comprising:

a housing including a bottom portion having a hole laterally formed therein, a tube including an extension rotatably engaged in said hole of said housing, said extension including a bore formed therein including an opening formed therein for communicating said bore with said hole of said housing, means securing said extension to said housing so as to allow said extension to rotate relative to said housing, a hose including a lower portion secured to said tube and including an upper portion, an attachment member secured to said upper portion of said hose, a lock member secured to said upper portion of said hose add including an inner thread formed therein, a connector including an annular slot formed therein for engaging with a sealing ring and including a lower portion threadly engaging with said inner thread of said lock member, and a barrel rotatably engaged on said connector and including an upper portion having an inner thread formed therein and including a lower portion having an annular rib extended radially inward therefrom for engaging with said connector so as to prevent said barrel from disengaging from said connector, said attachment member including an outer thread for engaging with said inner thread of said barrel so as to be secured to said barrel, said barrel being rotatable relative to said connector so as to allow said attachment member to rotate relative to said connector, and said extension being rotatable relative to said housing so as to allow said hose and said attachment member to rotate about said extension.

* * * * *